US008689443B1

(12) United States Patent
Burns et al.

(10) Patent No.: US 8,689,443 B1
(45) Date of Patent: Apr. 8, 2014

(54) METHOD AND APPARATUS TO IMPROVE PERFORMANCE OF POWER PLANT STEAM SURFACE CONDENSERS

(76) Inventors: John M. Burns, Topsfield, MA (US); Daniel C. Burns, Cary, NC (US); Jeffrey S. Burns, Salem, MA (US); Robert L. Stevens, Middletown, DE (US)

( * ) Notice: Subject to any disclaimer, the term of this patent is extended or adjusted under 35 U.S.C. 154(b) by 279 days.

(21) Appl. No.: 12/807,385

(22) Filed: Sep. 3, 2010

Related U.S. Application Data

(60) Provisional application No. 61/276,128, filed on Sep. 8, 2009.

(51) Int. Cl.
*B21D 51/24* (2006.01)

(52) U.S. Cl.
USPC ..... 29/890.051; 29/890.03; 60/648; 60/661; 165/112; 165/114

(58) Field of Classification Search
USPC ..... 29/890.03, 890.051, 890.031; 60/648, 60/686, 690, 685, 657, 661; 165/112, 114, 165/DIG. 188, DIG. 213
See application file for complete search history.

(56) References Cited

U.S. PATENT DOCUMENTS 3,349,841 A * 10/1967 Stoker ..... 165/113

* cited by examiner

*Primary Examiner* — Richard Chang
(74) *Attorney, Agent, or Firm* — Patrick J. Walsh

(57) ABSTRACT

The invention apparatus and method is practiced in large steam surface condensers and in one aspect comprises relatively narrow horizontal trays installed between the vertical tube bundles to drain the condensate from the upper bundle around the lower ones and thereby improve the heat transfer coefficient of the lower bundle(s). A second aspect of the invention apparatus comprises relatively narrow horizontal trays installed slightly below the lowest bundle to improve reheating of falling condensate up toward the saturation temperature of the condenser thereby reducing subcooling and the level of dissolved oxygen in that condensate. A third aspect of the invention apparatus comprises a partial hood retrofitted at the top of the central tubesheet air off-take entrance which is a unique element of the starburst/core pipe condenser design to thereby improve the air removal capability and consequently the performance of the condenser.

4 Claims, 2 Drawing Sheets

METHOD AND APPARATUS TO IMPROVE PERFORMANCE OF POWER PLANT STEAM SURFACE CONDENSERS

This application claims priority of U.S. application Ser. No. 61/276,128 filed Sep. 8, 2009.

FIELD OF THE INVENTION

This invention improves several aspects of performance of a steam power plant surface condenser. The invention applies to the large condensers installed in either nuclear or fossil power plants whose tube bundles are of several identifiable design configurations.

BACKGROUND OF THE INVENTION

In a steam-electric power plant, high energy steam is produced by either a boiler, steam generator or nuclear reactor. This high pressure, high temperature steam is conveyed by piping to a steam turbine. Here the energy of the flowing steam acts on blades in order to rotate the turbine shaft that is directly connected to an electrical generator which produces the power for homes, hospitals, schools and industry. Exhaust steam from the turbine is condensed into water in the condenser and is pumped back to the steam generator, boiler or reactor where the cycle is repeated. All steam fossil fired and nuclear power plants follow this basic cycle called the Rankine cycle in honor of a famous, early thermodynamacist.

This invention is directed to apparatus installed in the power plant condenser now described in detail.

The spent, low energy steam flows from the exhaust of the turbine into a large heat exchanger called a surface condenser where, as the name implies, the steam is condensed. In the large sizes associated with 1000MW plants, the condenser is as large as a church. Inside the condenser shell there are thousands of small diameter thin tubes that extend from a cold water inlet to a warm water outlet. The tubes are connected at their ends through tubesheets to chambers called waterboxes. The tubes are arrayed in forms with distinct patterns called tube bundles. A large quantity of cooling water flows through the tubes in order to condense the steam and continually carry away the heat of condensation to a source like a river, lake, ocean or cooling tower. The exhaust steam from the turbine enters the entire periphery of the tube bundles in a non-uniform, radial way and flows toward the center of each tube bundle through the immense number of tubes, condensing as it goes toward the air cooler section. The air cooler section extends along the length of the condenser between tube sheets.

In the air cooler, the last of the steam is condensed, non-condensable gases with some associated remaining steam vapor are collected along the length of the tube bundle and induced to flow to the cold water inlet end of the condenser. There all the non-condensable gases are discharged from air cooler section into the piping connected to air removal equipment.

Meanwhile, the condensate falls by gravity into the lower section of the condenser called a hotwell. But since the steam velocities in the condenser are of hurricane magnitudes (though at a low pressure and density) of from 50 to 400 ft/sec, as it drops, the steam is also pushed toward the vertical center of the condenser by the latter horizontal dynamic forces. To prevent tube vibration and provide support against the many categories of force loadings the tubes and the condenser must carry, all the tubes run through a multitude of support plates at intervals of from 2 to 4 ft. along their length.

Like the tubesheets at the ends of the tubes, these plates are drilled to reflect the precise pattern of the tube bundles.

Condenser and turbine performances are interconnected. For a particular set of cooling water conditions, i.e., the temperature and flow rate available, and depending on the overall heat transfer coefficient of the condenser, amount of active tube surface and the steam to be condensed from the turbine, the condenser pressure will be established. Except for a small pressure loss, the condenser pressure essentially defines turbine backpressure. And turbine backpressure in turn determines the power the turbine produces at that time for a specific turbine inlet pressure and temperature (throttle condition). The condenser pressure has a surprising large impact on a typical steam turbine and effects its produced power by 1% to 3% for a change of 1 in. of hg (0.491 psi) in absolute pressure. In these days of heightened awareness of conservation of energy, it is important to operate and maintain a condenser backpressure as low as possible under all conditions.

In the distant past, through the 1940s and 1950s, condensers were of a modest size because the plants they served were usually of no more than 100 to 150 MW. However, with requirements for larger and larger plants though the late 1960s to the 1980s and with the advent of nuclear plants and their higher quantities of steam and large size, condensers also grew, usually by an untested, rapid, simple size extrapolation. Some condenser designs worked well; some did not perform as well, particularly after design extrapolations to much larger sizes. Because of the major size of a condenser, the past difficulty in conducting accurate tests, and the fact that utilities were regulated so that the extra costs could be passed through to the rate payers, any shortcoming in condenser performance was accepted provided the condenser operated reliably. In the late 1980s and through the 1990s there was little demand for power and during that period many of the companies that manufactured condensers ceased operation, letting go their design personnel and closing the doors. The utilities at this point were on their own if improvements in existing condensers performance were considered. Utilities as a rule did not have personnel possessing a sufficient detailed condenser design background in this equipment to take an effective action. The situation today is no different.

The field performance improvements represented by this invention apparatus provides improvement to large condensers, increases the thermal efficiency of the affected plants and thereby contributes to conserving energy. The invention improvement method and apparatus are based on our previous condenser design background at a major manufacturer and the inventors' observations and tests in the field over the past 40 years.

SUMMARY OF THE INVENTION

The method and apparatus of the invention in one aspect comprehend the thermodynamic effect of falling condensate on exhaust steam within the condenser but not yet condensed, especially steam within lower tube bundles. Falling condensate originating in upper tube bundles is deflected around lower tube bundles and directed to flow outside tube bundles and into the condenser hotwell.

In another aspect of the invention, condensate rain flow from lower tube bundles is restrained from a tendency to flow toward a transverse centerline of condenser tube bundles, a condition where condensate temperature falls below steam saturation temperature (i.e., condensate subcooling) and further where condensate is susceptible to absorbing gas. Absorbed gas in condensate especially dissolved oxygen has a corrosive effect on upstream equipment and piping. Restraint and diversion of condensate in this aspect of the invention also promotes reheating as condensate falls toward the hotwell.

Another aspect of the invention pertains to an existing and widely used design of condensers where an air cooler section exit and the entrance to off-take piping are spaced apart across the inlet bay of the condenser, and where non-condensable gases moving from exit to entrance encounter condensate rain falling within the inlet bay. There are significant adverse thermodynamic and condenser performance effects resulting from the ensuing maelstrom interfering with non-condensable gas flow. This aspect of the invention provides a hood that protects gas flow from exit to entrance so as to ensure condenser performance to design specifications.

Specific examples are included in the following description for purposes of clarity, but various details can be changed within the scope of the present invention.

OBJECTS OF THE INVENTION

An object of the invention is to diminish undesirable thermodynamic and condenser performance effects attributable to free falling condensate rain within a surface steam condenser.

Another object of the invention is to redirect condensate falling from upper tube bundles away from steam condensing surfaces of lower tube bundles.

Another object of the invention is to diminish undesirable thermodynamic and condenser performance effects of condensate rain from lower tube bundles.

Another object of the invention is to reduce susceptibility of condensate rain falling from lower tube bundle to absorbing non-condensable gases especially dissolved oxygen.

Another object of the invention is to protect flow stream of non-condensable gases in space between air cooler section exit and entrance to off-take piping.

Other and further objects of the invention will become apparent with an understanding of the following detailed description of the invention or upon employment of the invention in practice.

BRIEF DESCRIPTION OF THE DRAWING

Preferred embodiments of the invention have been chosen for detailed description to enable those having ordinary skill in the art to which the invention appertains to readily understand how to construct and use the invention and is shown in the accompanying drawing in which.

DETAILED DESCRIPTION OF PREFERRED EMBODIMENT OF THE INVENTION

1. Intermediate Baffles Between Bundles

Figure 2:
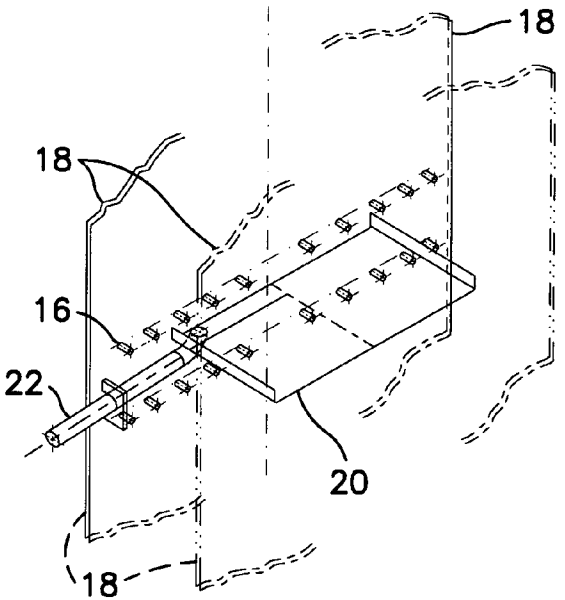
FIG. 2 is a fragmentary perspective view of installation of drain tray for upper tube bundle.
Figure 3:
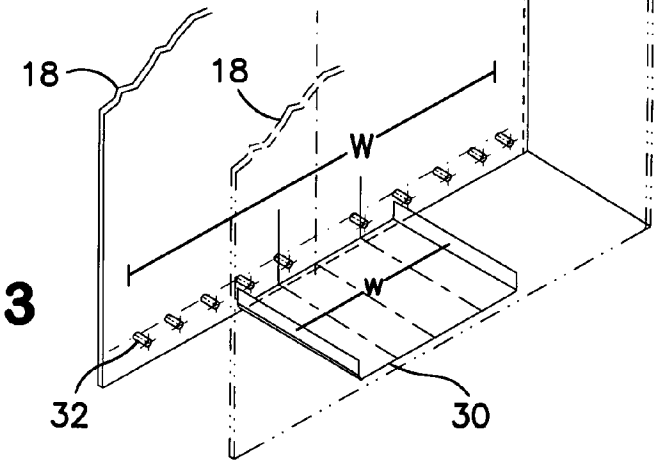
FIG. 3 is a fragmentary perspective view of installation of drain tray for lower tube bundle.
Figure 1:
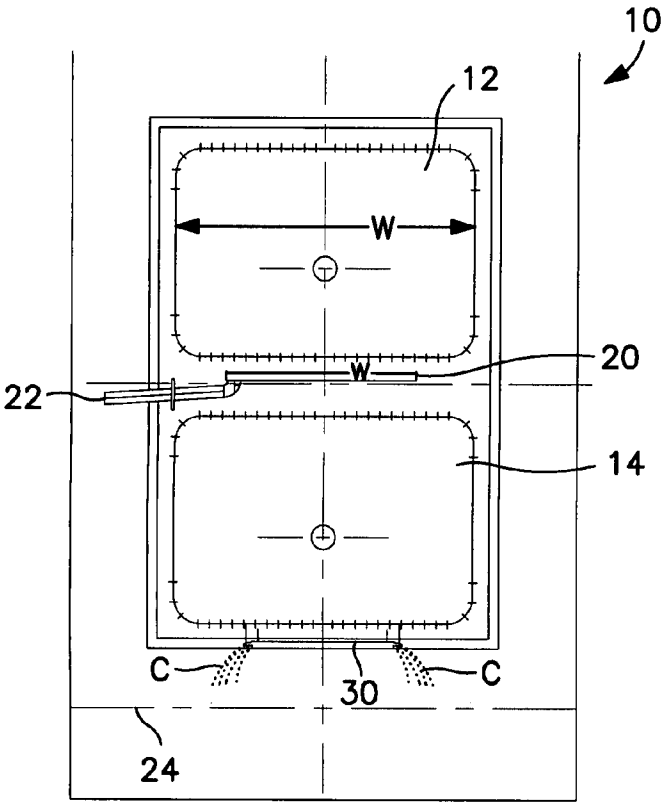
FIG. 1 is an elevation view showing location of drain trays with respect to upper and lower tube bundles in a power plant steam surface condenser.

Referring to FIGS. 1-3 of the drawing, it is to be understood that when the design of condenser 10 is such that two or more large tube bundles 12, 14 are arrayed vertically, the water loading of the steam condensed (condensate) in the upper bundle falls through the lower bundle. The extra condensate rain in the lower bundle however can be sufficiently heavy that it measurably reduces the heat transfer coefficient of that lower bundle. The excess condensate loading also increases the pressure loss of the steam flow in the lower bundle. That consequently reduces steam saturation temperature during the condensation process and thus has a further negative impact on performance of the condenser. It is to be noted that the condensate rain in the upper bundle is pushed toward the transverse centerline of the tube bundle by the dynamic action of the condensing steam flowing through the tube bundle.

To prevent tube vibration of tubes 16 and provide support against the many categories of force loadings the tubes and the condenser must carry, all the tubes run through a multitude of support plates 18 at intervals of from approximately 2 to 4 ft. along their length. Like the tubesheets at the ends of the tubes, these plates are drilled to reflect the precise pattern of the tube bundles.

One element of this invention apparatus is a relatively narrow horizontal tray 20 installed between support plates 18 parallel to the direction of the tubes 16 between the two vertically adjacent tube bundles 12, 14. As illustrated in FIGS. 1 and 2, tray is installed at the bottom of the upper bundle to catch the majority of the condensate from that bundle and drain it through pipe 22 around the lower bundle to hotwell 24 in order to minimize the condensate loading effects on the lower bundle. The facility for drainage of the condensate can take many forms. The identified existing condenser design installations to which this invention is applicable do not now include similar baffles or trays.

This tray can be applied alone or in conjunction with any or both of the other elements of this invention apparatus. The trays of the invention would be relatively narrow because as indicated above the condensate load is more intense at the center, such that selected tray geometry minimizes any interference effects on the proper steam flows entering the bundles and further simplifies design hardware and installation efforts. In a preferred embodiment shown in FIG. 1, width w of tray 20 is in a range of one-half to three-quarters, and preferably, two thirds tube bundle width W.

The specifics of each application would be tailored to the particular set of engineering and economic circumstances and to achieve an improvement in heat transfer performance, these trays can be installed in each or only at selected support plate bays along the length of the condenser.

2. Lowest Bundle Reheat Baffles

In like manner to the description of condenser steam dynamics within the upper tube bundle, lower bundle condensate rain is pushed toward the transverse centerline of the tube bundle by the action of the condensing steam flowing through that tube bundle. As a result of the detailed condensation process including direct contact with the cold tube surface and the agglomeration of the condensate toward the center, the condensate temperature can fall below the saturation temperature of the steam that corresponds to the pressure of condensation. Besides simply losing temperature, the condensate is vulnerable to the absorption of any gas surrounding its droplets and surface areas. This heavy stream of condensate then quickly falls by gravity from the lowest tube bundle into the hotwell and can contain dissolved oxygen gas and can be cooler than the condenser saturation temperature.

In order to minimize the corrosion on upstream components of the equipment and piping of the condensate, feedwater systems and the steam generators, the level of dissolved oxygen in the condensed steam (condensate) must be as low as possible. As mentioned, without any reheating, the condensate streaming from the lowest tube bundle into the hotwell could be subject to appreciable subcooling (the difference between steam saturation temperature and condensate actual temperature). Subcooling of any magnitude has the effect of reducing the thermal efficiency of the power cycle and also increasing the drain flows back to the condenser through the heaters to possibly interfere with the reliable operation of the plant.

In certain existing condensers, however no design hardware elements are installed below the lowest tube bundle to aid in reheating the condensate up to its saturation temperature so as to minimize both subcooling and any dissolved oxygen.

To address that situation, another element of this invention is a relatively narrow horizontal tray 30 (FIGS. 1 and 3) installed between support plates 18 parallel to the direction of the tubes 32 between the lowest tube bundle and the hotwell water level 24. The tray is installed at the bottom of the lowest bundle to catch the majority of the condensate. Here the captured condensate is briefly arrested from falling further. Condensate flow C is broken up into small streams capable of being reheated by steam moving toward the general entrance to the lowest tube bundle and retention time in that environment increased all with the purpose of aiding in reheating the condensate up toward the saturation temperature.

The identified existing condenser design installations to which this invention is applicable do not now include similar baffles or trays. This tray is applied alone or in conjunction with any or both of the other elements of this invention apparatus. It is utilized for the lowest bundle in any vertical tube bundle number. The trays of the invention are relatively narrow because as described above, the condensate load is more intense at the center, because that geometry will minimize any interference effects on the proper steam flows entering the lower bundle, and because it simplifies the design hardware and installation efforts. The specifics of each application are tailored to the particular set of engineering and economic circumstances. To achieve an improvement in reheating and the dissolved oxygen performance, these trays are installed in each support plate bay or only at selected bays along the length of the condenser. In a preferred embodiment shown in FIG. 3, width w of tray 30 is in a range of one-third to two-thirds, and preferably, four-tenths of tube bundle width W. The tray is affixed by suitable means such as welding along side edges 30*a-b* to support plates 18. The tray further includes side walls 30*c-d* for defining the shallow tray for collecting falling condensate and for spilling the condensate C over the side walls into the hotwell.

3. Air Cooler Off-Take Hood

Because the condenser operates under a strong vacuum, it is subject to air inleakage, i.e., ambient air drawn through crevasses and the like into the condenser. Further, Boiling Water Reactor nuclear designs produce substantial quantities of other non-condensable gases that end up in the condenser. In order to maximize the power and thermal efficiency of the plant, all of these gases must be continually removed from a condenser. A condenser has an air cooler section where non-condensable gases are concentrated, routed to the inlet end of the condenser, and then conveyed to air removal equipment. The air cooler is at the heart of the condenser, is the ultimate destination of steam flows entering each tube bundle, and represents the end of the condensation process. The air cooler has an important function in the condensation process because it must efficiently remove the non-condensable gases. Otherwise, non-condensable gases will build up causing steam flows in large sections of the tube bundle to stagnate thereby causing an overall deficiency in the heat transfer performance. Such stagnation reduces the active surface area of the condenser, increases condenser absolute pressure and steam turbine backpressure, and subsequently reduces the thermal efficiency and/or power output of the cycle. The air cooler thus contributes significantly to maintaining the condenser and hence steam turbine exhaust at an absolute pressure as low as possible for a particular set of operating conditions.

In the usual case of condensers installed in power plants, the air cooler is a section of the condenser isolated from the main tube bundle and comprises some number of tubes to produce final condensation. The air cooler section is attached to off-take piping internal to the condenser itself. So, non-condensable gases with entrained water vapor are directly piped from the inlet water end of the air cooler through internal steam spaces of a condenser and out to a connection called an air off-take.

Figure 4:
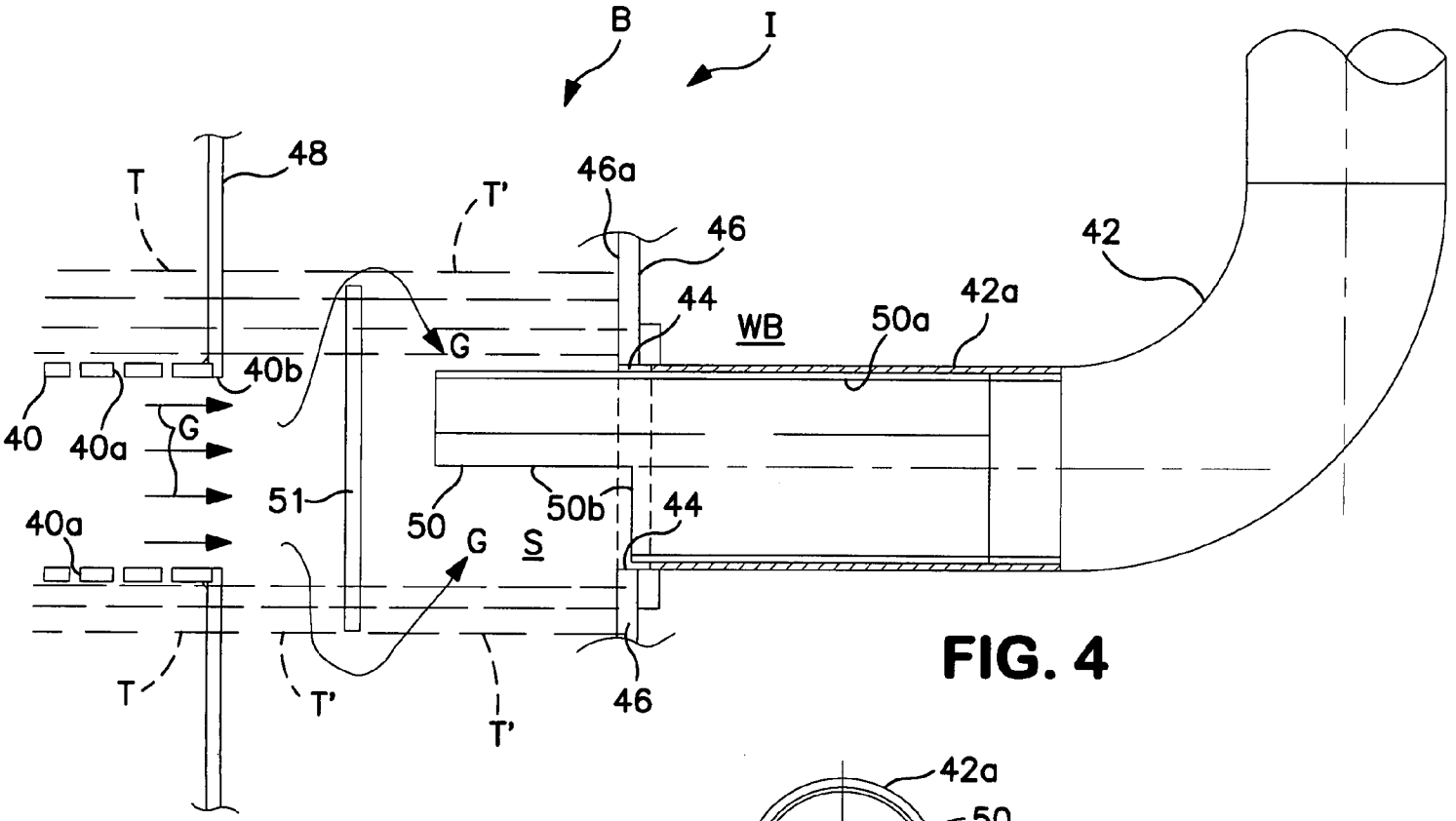
FIG. 4 is an elevation view partially in section of installation of air cooler hood for air vapor vent piping.
Figure 5:
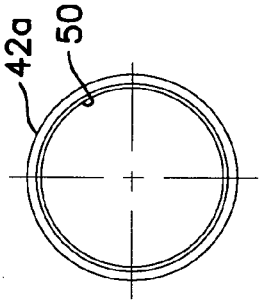
FIG. 5 is an end view of the air cooler hood of FIG. 4.

A significant exception to usual condenser air cooler arrangement is that of a former major manufacturer that designed and built hundreds of condensers with singularly identifiable tube bundles, which in a cross-sectional view, resemble a starburst pattern. They ceased their manufacturing efforts in the early 1980s. As shown in FIG. 4, the middle portion of the condenser of this design is a field of closely packed tubes T, and pipe 40 is in its center. Often termed a core pipe, for reasons of design economy, the air cooler of that former manufacturer with the starburst tube bundle pattern utilizes pipe 40 with slots and/or orifices 40*a*. The pipe runs from the outlet end of the condenser to the support plate bay B just before the inlet end I. The core pipe 40 contains no tubes. Non-condensable gases G and associated remaining vapor enter the orifices of the core pipe because of the slight pressure difference between the condensation pressure of the closely packed tubes surrounding the core pipe along the length of the condenser, and enter the open pipe 42 at the inlet end support plate bay. Within this starburst/core pipe design, after moving to the inlet end and then traversing the inlet end support plate bay, the non-condensable gases G and associated vapor are swept into a central penetration hole 44 in the inlet end tube sheet 46 that serves as the non-condensable gas off-take. Piping 42 is attached to the waterbox WB side of the tubesheet and exits the condenser proper through the inlet water box. This piping eventually terminates at the suction of the air removal equipment (not shown). The air cooler and off-take is a unique design arrangement in the condenser industry.

As was outlined, unlike all other manufacturer's condenser designs which extend the air cooler from tubesheet to tubesheet, the starburst/core pipe design terminates at the downstream end of the inlet end support plate bay B. A space S of several feet exists between the terminus 40*b* of the air cooler section and entry opening 44 to air off-take piping. Non-condensable gases must traverse the distance S—across that support plate bay—and in the process, around a central blockage plate 51 and pass over a small quantity of adjacent cold tubing T' and then radially to enter the air off-take piping situated at the center of the tubesheet. This blockage plate provided by the previous manufacturer causes condensation of a quantity of entrained steam vapor which is carried by the non-condensable gas stream. The presence or absence of a blockage plate in inlet bay B does not change the concept of the condenser improvement method or apparatus of the invention. This entire bay is a small longitudinal section of condenser tube bundle T' isolated from the remainder of the condenser tubes and is surrounded on one end by the tubesheet 46 and the other by a support plate 48 drilled to hold the tubes T. The support plate bay B is open on the top, sides and bottom to allow the entrance of the steam to be condensed in that section.

The coldest cooling water inside the tubes T exists at the inlet bay B so the heat transferred from the steam to the cooling water will be the greatest there and thus the steam condensed in the bay and its steam flow will be a maximum. As one typical result, even though the tube surface of the inlet end bay may only represent 5% of the total tube surface, over 10% of the entire steam flow could condense there. In addition, flowing steam velocities are the highest in this section. Non-condensable gases G of the starburst/core pipe condensers must traverse through this maelstrom to reach off-take piping 42. At the same time, the inside face 46*a* of the tubesheet will have a quantity of condensed steam (condensate) flowing down it. While in smaller design condenser sizes this arrangement may be adequate, for the large starburst/core pipe condensers that are installed on older plants of 500 MW or more—of which there are likely over 100—the amount of water (condensate) flowing down the tubesheet will be very appreciable and so has the potential to block the entrance 44 to air off-take piping.

As an example of a large condenser application, a 1000 MW nuclear plant's condenser may condense 5 million lbs of steam per hour. Usually this is accomplished in four large tube bundles that are perhaps 12 ft by 12 ft in size. The space available for the condensate flow between the tubes is small, likely 50% or less of the total width. With half of 10% the steam condensed in the top portion of the inlet bay of one bundle above the central airoff-take penetration, that estimates 125 gallons per minute of condensate is cascading down in the vicinity of air off-take piping through the inlet end support plate bay. With a pressure gradient existing at the air off-take entrance promoting an attraction, much of this flow may run down the tubesheet to block its entrance. When applied to smaller condensers, these conditions are not as extreme and the open core pipe with the air off-take in the tubesheet should function suitably.

Such blockage of the off-take piping entrance causes the condenser to have a poor non-condensable gas removal characteristic: by causing an excess pressure loss, the blockage reduces suction pressure at the air removal equipment causing it to loose capability and the blockage promotes entraining excess condensate to be sucked into the non-condensable gas off-take piping that then further interferes with the air removal. As has been indicated, the loss of air removal capability will promote stagnation and produce a major loss in the overall heat transfer coefficient of the condenser. If the stagnation zone extends into the lower sections of the lower tube bundle near the hotwell, it can also cause an increase in the subcooling and dissolved oxygen in the condensate.

In this description "penetration" refers to action of non-condensable gases G and associated vapor in traversing space S between air cooler exit 40*b* and off-take entrance 44 under influence of condensation pressure at orifices 40*a* and pressure gradient at entrance 44 due to suction of air removal equipment. "Penetration" is also shorthand for space S so traversed.

The invention disclosed below mitigates those negative effects.

To improve the described entrance situation at the air off-take piping with respect to large starburst/core pipe condenser designs, another element of this invention is a partial hood 50 installed to extend out slightly over the top of the existing off-take penetration. The hood provides protection from the condensate streaming down the tubesheet. The hood is retrofitted and attached suitably with an appropriate size, thickness and metallurgy onto the existing off-take piping. As illustrated in FIG. 4, the hood 50 is a semi-circular section of hood pipe 50*a* installed at the elbowed end 42*a* of the non-condensable piping that runs through the inlet waterbox. Hood 50 defined by margins 50*b* extends into space S to protect penetration, that is, flow of gases G and associated vapor into off-take pipe. The identified existing large condenser installations of the starburst/core pipe design to which this invention would be applicable do not now include similar hoods. This hood can also be retrofitted alone or in conjunction with any or both of the other elements of this invention apparatus.

The space S is normally several feet long and hood 50 can extend entirely or partly across the space. The specifics of each application are tailored to the particular set of engineering and economic circumstances to achieve an improvement in non-condensable gas removal by improving the entrance conditions at the existing air off-take in all or selected air offtakes of a particular condenser.

The term approximately for purposes of this application means plus or minus 10% of the values stated.

The methods of the invention are as follows.

The invention provides a method for improving the performance of steam surface condensers including these steps:

1. organizing a multitude of tubes for condensing steam into a plurality vertically adjacent upper tube bundles and lower tube bundles,
2. forming support plate bays along the length of the tubes,
3. installing a tray in support plate bays underneath upper tube bundles,
4. catching condensate from the upper tube bundle, and
5. draining the condensate around the lower tube bundle to the hotwell.

The method so performed improves the heat transfer coefficient of the lower tube bundle and produces an improvement in the overall heat transfer coefficient of the condenser and thus effecting a reduction in the backpressure of the steam turbine to increase the power and the thermal efficiency of the plant.

The invention provides another method for improving the performance of steam surface condensers including the following steps:

1. organizing a multitude of tubes for condensing steam into a plurality vertically adjacent upper tube bundles and lower tube bundles,
2. forming support plate bays along the length of the tubes,
3. installing a tray in support plate bays underneath the bottom of lower tube bundles,
4. catching condensate from the lower tube bundle,
5. briefly arresting the condensate from falling further,
6. and breaking up condensate flow into small streams,
7. using steam for reheating the condensate up to saturation temperature as the condensate falls to the condenser.

This method reduces the level of oxygen dissolved in the condensate and so reduces the corrosion effects of components upsteam of the condenser in the power cycle and reduces any condensate subcooling to increase the power and thermal efficiency of the plant.

A further method provided by the invention involves the following steps. The method improves performance of steam surface condensers by means of the steps of:

1. organizing a multitude of tubes for condensing steam in starburst pattern,
2. extending the tubes between tube sheets located at inlet end and outlet end of the condenser,
3. defining a support plate bay where cooling water passing through tubes generates a condensate rain, 4. locating an air cooler section at the center of the multitude of tubes for receiving non-condensable gases,
5. directing non-condensable gases through the air cooler section across a support plate bay,
6. providing an entry opening in the inlet end tube sheet for receiving non-condensable gases across the support plate bay,
7. drawing non-condensable gases into an entry opening in off-take pipe,
8. conducting non-condensable gases to air removal equipment, and,
9. covering non-condensable gases penetrating the support bay to protect non-condensable gases from condensate rain. This method improves non-condensable removal capability, and increases overall heat transfer coefficient, and produces a reduction in the backpressure of the steam turbine to increase the power and the thermal efficiency of the plant.

Various changes may be made to the methods and structures embodying the principles of the invention. The foregoing embodiments are set forth in an illustrative and not in a limiting sense. The scope of the invention is defined by the claims appended hereto.

We claim:

1. An apparatus comprising a surface steam condenser installed in a power plant, the condenser having a hotwell, the condenser having multitude of tubes for condensing steam into condensate, the multitude of tubes organized into a plurality vertically adjacent upper tube bundles and lower tube bundles, the upper and lower tube bundles having a length, the condenser having a multitude of support plates spaced at intervals for defining support plate bays along the length of the tube bundles, the tubes running through the support plates, a tray installed between support plates in at least one bay at the bottom of an upper tube bundle to catch condensate from the upper tube bundle and to drain the condensate around the lower tube bundle to the hotwell so as to improve the heat transfer coefficient of the lower tube bundle thereby producing an improvement in the overall heat transfer coefficient of the condenser and thus effecting a reduction in the backpressure of the steam turbine to increase the power and the thermal efficiency of the plant.

2. An apparatus as defined in claim 1 in which the tray has a pipe for draining condensate around the lower tube bundle.

3. An apparatus comprising a steam surface condenser installed in a power plant, the condenser having a hotwell, a multitude of tubes for condensing steam into condensate, the multitude of tubes organized into a plurality vertically adjacent upper tube bundles and lower tube bundles, the upper and lower tube bundles having a length, each of the upper and lower tube bundles having a width, a multitude of support plates spaced at intervals for defining support plate bays along the length of the tube bundles, the tubes running through the support plates, a tray installed between support plates in at least one bay at the bottom of an upper tube bundle to catch condensate from the upper tube bundle and to drain the condensate around the lower tube bundle to the hotwell, and the width of the tray being in a range of one-half to three-quarters of upper tube bundle width.

4. An apparatus comprising a steam surface condenser having a hotwell installed in a power plant, a multitude of tubes for condensing steam into condensate, the multitude of tubes organized into a plurality vertically adjacent upper tube bundles and lower tube bundles, the upper and lower tube bundles having a length, a multitude of support plates spaced at intervals for defining support plate bays along the length of the tube bundles, the tubes running through the support plates, a first tray installed between support plates in at least one bay at the bottom of an upper tube bundle to catch condensate from the upper tube bundle and to drain the condensate around the lower tube bundle to the hotwell so as to improve the heat transfer coefficient of the lower tube bundle thereby producing an improvement in the overall heat transfer coefficient of the condenser and thus effecting a reduction in the backpressure of the steam turbine to increase the power and the thermal efficiency of the plant, a second tray installed between support plates in at least one bay at the bottom of a lower tube bundle to catch condensate from the lower tube bundle and to briefly arrest the condensate from falling further, and to break up condensate flow into small streams, and by steam to reheat the condensate up to saturation temperature as the condensate falls to the hotwell thereby to reduce the level of oxygen dissolved in the condensate and so reduce the corrosion effects of components upsteam of the condenser in the power cycle and to reduce any condensate subcooling to increase the power and thermal efficiency of the plant.

* * * * *